US006183687B1

(12) United States Patent
Greenfield

(10) Patent No.: US 6,183,687 B1
(45) Date of Patent: Feb. 6, 2001

(54) HARD COMPOSITE AND METHOD OF MAKING THE SAME

(75) Inventor: Mark S. Greenfield, Greensburg, PA (US)

(73) Assignee: Kennametal Inc., Latrobe, PA (US)

( * ) Notice: Under 35 U.S.C. 154(b), the term of this patent shall be extended for 0 days.

(21) Appl. No.: 08/514,283

(22) Filed: Aug. 11, 1995

(51) Int. Cl.[7] ..... B22F 3/24; B22F 3/26
(52) U.S. Cl. ..... 419/18; 419/27; 419/29
(58) Field of Search ..... 419/8, 14, 26, 419/18, 27, 29

(56) References Cited

U.S. PATENT DOCUMENTS

| | | | |
|---|---|---|---|
| Re. 34,180 | 2/1993 | Nemeth et al. | 428/547 |
| 2,888,247 | 5/1959 | Haglund | 255/63 |
| 3,994,692 | 11/1976 | Rudy | 29/182.5 |
| 4,194,790 | 3/1980 | Kenny et al. | 299/79 |
| 4,359,335 | 11/1982 | Garner | 75/208 R |
| 4,484,644 | 11/1984 | Cook et al. | 175/410 |
| 4,705,124 | 11/1987 | Abrahamson et al. | 175/410 |
| 4,722,405 | 2/1988 | Langford, Jr. | 175/374 |
| 4,854,405 | 8/1989 | Sroud | 175/374 |
| 5,333,520 | 8/1994 | Fischer et al. | 76/108 |
| 5,467,669 * | 11/1995 | Stroud . | |

FOREIGN PATENT DOCUMENTS

| | | |
|---|---|---|
| 8813731 U | 5/1989 | (DE) . |
| 0072175 | 2/1983 | (EP) . |
| 0111600 | 6/1984 | (EP) . |
| 0194018 | 9/1986 | (EP) . |
| 0194018 | 10/1986 | (EP) . |
| 0257869 | 3/1988 | (EP) . |
| 0497781 | 8/1992 | (EP) . |
| 1132959 | 3/1957 | (FR) . |
| 2223472 | 10/1974 | (FR) . |
| 2343885 | 10/1977 | (FR) . |
| 911461 | 11/1962 | (GB) . |
| 1115908 | 10/1965 | (GB) . |
| 1383429 | 2/1974 | (GB) . |

(List continued on next page.)

OTHER PUBLICATIONS

"Modern Developments in Powder Metallurgy," Proceedings of the 1980 International Powder Metallurgy Conference, Ed. Hausner, Henry H. et al., vol. 14, at pp. 269–279.

Santhanam, A. T., et al., "An Advanced Cobalt–Enriched Grade Designed to Enhance Machine Productivity," Paper 8503–003, at ASM Conference on Machining, May 7–9, 1995, Metals Park, OH.

Nemeth et al., "The Microstructural Features and Cutting Performance of the High Edge Strength Kennametal Grade KC850," Proc. Tenth Plansee Seminar, 1981, at pp. 613–627.

Viswanadham, R. K., "Stability of Microstructural Discontinuities in Cemented Carbides," International Journal of Powder Metallurgy, Oct. 1987, USA, vol. 23, No. 4, ISSN 0361–3488, pp. 229–235.

(List continued on next page.)

*Primary Examiner*—Daniel J. Jenkins
(74) *Attorney, Agent, or Firm*—John J. Prizzi

(57) ABSTRACT

A method of heat treating a sintered body having an exposed surface which has the steps of: providing a sintered body comprised of a hard carbide and a binder, the binder being present in the sintered body at a first binder level and the hard carbide in the sintered body being of a first grain size; placing granules of a sacrificial sintered material in contact with at least one portion of the exposed surface of the sintered body, the sacrificial sintered material comprised of the hard carbide and the binder, the binder being present in the sacrificial sintered material at a second binder level and the hard carbide in the sacrificial sintered material being of a second grain size; and heat treating the sintered body and sacrificial sintered material so as to change the binder content in a surface region of the sintered body.

16 Claims, 5 Drawing Sheets

U.S. PATENT DOCUMENTS

| | | |
|---|---|---|
| 1404752 | 9/1975 | (GB) . |
| 2017153 | 3/1979 | (GB) . |
| 2109009 | 5/1983 | (GB) . |
| 2211875 | 7/1989 | (GB) . |
| 59107060 | 5/1991 | (JP) . |
| 52-110209 | 8/1992 | (JP) . |

OTHER PUBLICATIONS

Richter, V., "Fabrication and Properties of Gradient Hard Metals," 3rd International Symposium on Structural and Functional Gradient Materials, Proceedings of FGM '94, Lausanne, Switzerland, Oct. 10–12, 1994, 1995, Lausanne, Switzerland, Presses Polytech. Univ., Romandes, Switzerland, whole document.

* cited by examiner

HARD COMPOSITE AND METHOD OF MAKING THE SAME

BACKGROUND

The invention pertains to a hard composite that is made via sintering techniques. More specifically, the invention pertains to a hard composite that is made via sintering techniques that are able to control the extent and depth of cobalt enrichment in the region of the surface of the hard composite.

In hard composites like cemented tungsten carbides, the binder (e.g., cobalt) content has an influence on the properties of the composite. For example, an increase in cobalt content typically leads to an increase in toughness of the composite. Heretofore, there has been a desire to be able to have a binder-enriched region near the surface of a hard composite. For example, United States Reissue Pat. No. 34,180, to Nemeth et al., assigned to the assignee of the present patent application, discloses a method that produces a hard composite with binder enrichment in the surface region, as well as discloses such a product.

Typical applications that would find hard composites that have surface binder enrichment to be desirable would be wear applications, mining applications, construction applications, and metalcutting applications. Wear parts like wire drawing dies would find a hard component with such a microstructure to be advantageous. In the mining applications, mining tools like roof bits, open face style tools, and conical style tools would find a use for a hard insert with a microstructure presenting binder enrichment in the surface region. In the construction applications, rotatable construction tools would find a hard insert with a microstructure presenting binder enrichment in the surface region to be advantageous. In metalcutting applications, a cutting tool that has a microstructure with binder-enrichment in the surface region would be advantageous.

SUMMARY

It is an object of the invention to provide an improved method of making a hard composite with binder-enrichment in the surface region, as well as the hard composite that has binder-enrichment in the surface region.

In one form thereof, the invention is a method of heat treating a sintered body having an exposed surface. The method comprises the steps of: providing a sintered body comprised of a hard carbide and a binder, the binder being present in the sintered body at a first binder level and the hard carbide in the sintered body being of a first grain size; placing granules of a sacrificial sintered material in contact with at least one portion of the exposed surface of the sintered body, the sacrificial sintered material comprised of the hard carbide and the binder, the binder being present in the sacrificial sintered material at a second binder level and the hard carbide in the sacrificial sintered material being of a second grain size; and heat treating the sintered body and sacrificial sintered material so as to change the binder content in a surface region of the sintered body.

In another form thereof, the invention is a hard insert produced by a process comprising the following steps: providing a sintered body comprised of a hard carbide and a binder, the binder being present in the sintered body at a first binder level and the hard carbide in the sintered body being of a first grain size; placing granules of a sacrificial sintered material on at least one portion of the exposed surface of the sintered body, the sacrificial sintered material comprised of the hard carbide and the binder, the binder being present in the sacrificial sintered material at a second binder level and the hard carbide in the sacrificial sintered material being of a second grain size; and heat treating the sintered body and sacrificial sintered material so as to change the binder content in a surface region of the sintered body.

BRIEF DESCRIPTION OF THE DRAWINGS

The following is a brief description of the drawings which form a part of this patent application.

DETAILED DESCRIPTION

Figure 1:
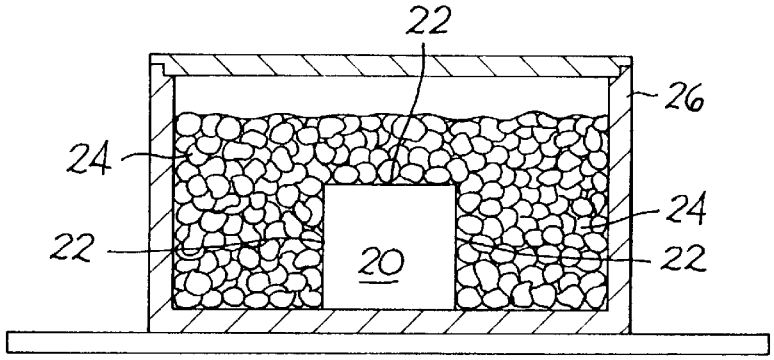
FIG. 1 is a side view of the arrangement in the furnace wherein the sintered body is surrounded by granules of sacrificial sintered material.

Referring to the drawings, FIG. 1 illustrates an arrangement wherein a sintered body 20 has the exposed surfaces 22 thereof in contact with granules of a sacrificial sintered material 24. The sintered body 20 and the sacrificial sintered material 24 are each comprised of a hard carbide such as, for example, tungsten carbide and a binder metal, such as, for example, cobalt.

The cobalt content of the sintered body 20 and the sacrificial sintered material 24 are typically different, but it is within the scope of the invention that the cobalt contents are the same. The grain size of the tungsten carbide (or hard carbide) in the sintered body 20 and the sacrificial sintered material 24 are typically different, but it is within the scope of the invention for these grain sizes to be the same. However, for the invention either or both of the cobalt content and the grain size for the sintered body and the sacrificial sintered material must be different.

The sintered body 20 and the sacrificial sintered material 24 are located within the volume of a furnace 26. During the heat treatment of the combination of the sintered body 20 and the sacrificial sintered material 24 there is a migration of binder, e.g., cobalt, into or out of the sintered body 20. The direction of migration is dependent upon the cobalt content and the grain size of the sintered body and the sacrificial sintered material 24.

When the cobalt content in the sintered body is less than that in the sacrificial sintered material (and the grain size of the tungsten carbide is essentially the same), the cobalt migrates into the sintered body. When the grain size of the tungsten carbide in the sintered body is finer than that in the sacrificial sintered material (and the cobalt content is essentially the same), the cobalt migrates into the sintered body.

The increase in cobalt at the surface of the sintered body results in a migration of cobalt toward the interior. Such a migration creates a cobalt profile wherein there is an increase (or enrichment) of cobalt in the surface region of the sintered body. A decrease in cobalt at the surface of the sintered body results in a migration of cobalt away from the interior of the sintered body and into the sacrificial sintered material. Such a migration creates a cobalt profile wherein there is an decrease (or depletion) of cobalt in the surface region of the sintered body.

The extent of cobalt enrichment (or depletion) and the depth of enrichment (or depletion) in the sintered body is dependent upon the specific cobalt content and grain size differentials, as well as the time and temperature of the heat treatment, which is typically sintering. In this regard, the greater the differential, the more pronounced will be the change (enrichment or depletion) in the cobalt content. The greater the time and/or temperature of sintering, the greater will be the depth and extent of enrichment or depletion.

A description of a first example of the present invention is set forth below. A plug of sintered material, i.e., the sintered body, having a composition of about 6 weight percent cobalt, about 0.2 weight percent vanadium, and the balance tungsten carbide was sectioned and the cobalt profile thereof measured via an energy dispersive x-ray analysis (EDS) technique. More specifically, to quantify the cobalt distribution within the sintered body, a mounted and polished sample was analyzed by standardless spot probe analysis using energy dispersive x-ray analysis (EDS). Specifically, a JSM-6400 scanning electron microscope (Model No. ISM64-3, JEOL Ltd., Tokyo, Japan) equipped with a $LaB_6$ cathode electron gun system and an energy dispersive x-ray system with a silicon-lithium detector (Oxford Instruments, Inc., Analytical System Division, Microanalysis Group, Bucks, England) at an accelerating potential of about 20 keV was used. The scanned areas measured about 125 micrometers by about 4 micrometers. Each area was scanned for equivalent time intervals (about 50 seconds live time). There were equal step sizes between adjacent areas.

Figure 5:
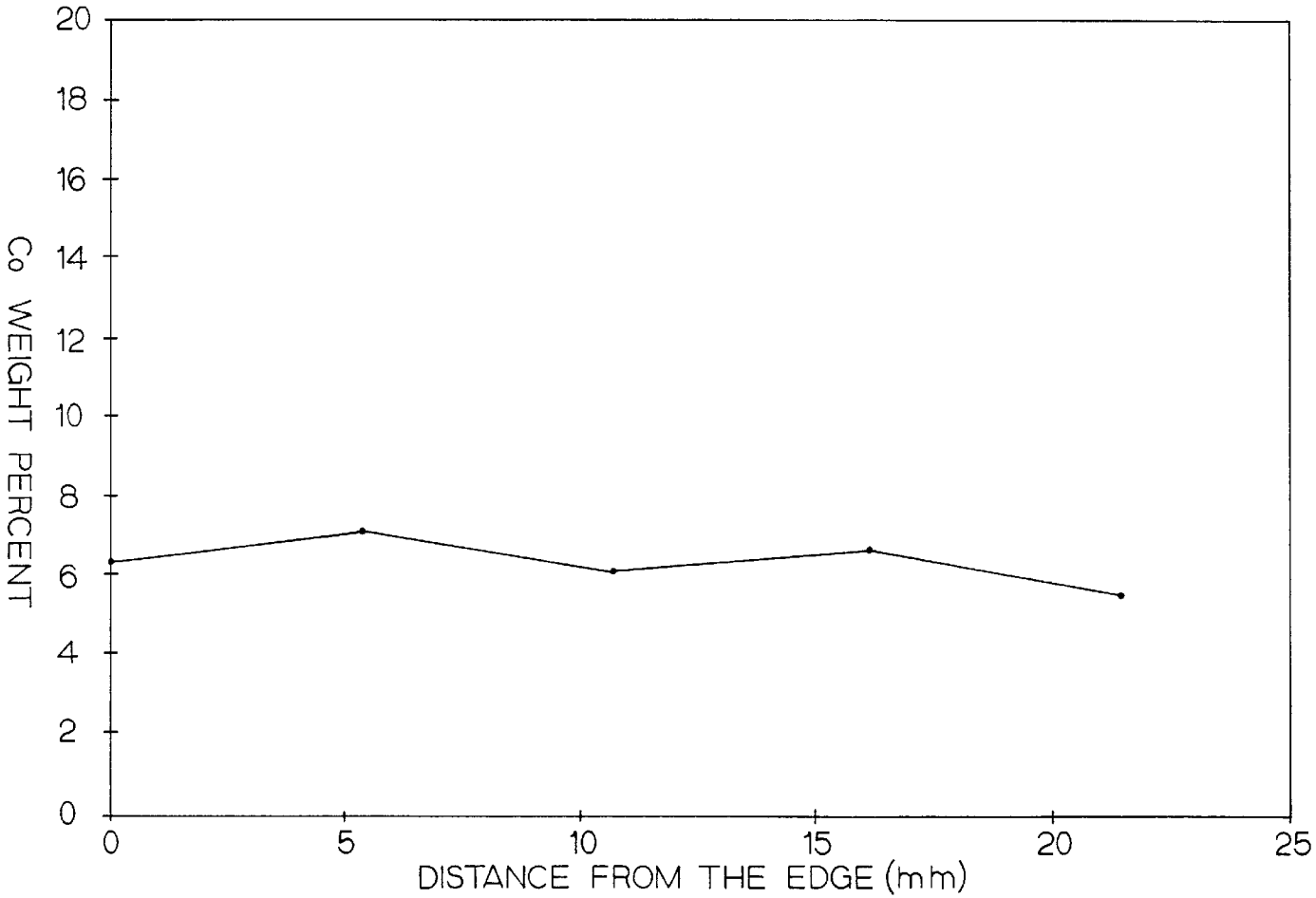
FIG. 5 is a cobalt profile (weight percent cobalt vs. distance from the surface in mm) for the sintered body (prior to the heat treatment) used in the first example.

FIG. 5 is the cobalt profile of the sectioned sintered body. The sintered body also had a coercive force, $H_c$, of about 350 Oe, and magnetic saturation of about 85 percent (a magnetic saturation of about 100 percent equals about 160 gauss-cubic centimeter per gram-cobalt, or 16 microtesla-cubic meter per kilogram-cobalt), and a tungsten carbide grain size of 1 micrometer.

The sintered body was then placed in a cup which was filled with coarse granules of a sacrificial sintered material of another composition. The composition and properties of this sacrificial sintered material was about 9.5 weight percent cobalt and the balance tungsten carbide. The coercive force $H_c$ was about 55 Oe, the magnetic saturation was about 96 percent, and the grain size of the tungsten carbide was between 1 and 25 micrometers. This combination was sintered at 2550° F. (1399° C.) for 45 minutes at temperature in a 15 torr argon atmosphere. It should be appreciated that other heat treating procedures are appropriate for this invention, including vacuum sintering, pressure sintering, and hot isostatic pressing.

After sintering, the weight of the sintered body had increased by 5.1 percent. An EDS analysis of a cross-section of the sintered body revealed that the cobalt content had increased to about 9 to 10 weight percent from the initial 6.2 weight percent. In terms of an absolute weight percent cobalt, this is an increase of 3 to 4 weight percent cobalt. In terms of a percentage, this increase is in the range of 140 percent to 170 percent.

As previously mentioned, FIG. 5 is a cobalt profile for the sintered body prior to the heat treatment. This profile shows that the cobalt content before heat treating is uniform and well below the 9 to 10 weight percent level. It is apparent that the differential in the cobalt content (6.2 weight percent vs. 9.5 weight percent) and the grain size (1 micrometer vs. 1 to 25 micrometers) resulted in the migration of cobalt from the sacrificial sintered material into the surface of the sintered body.

Figure 2:
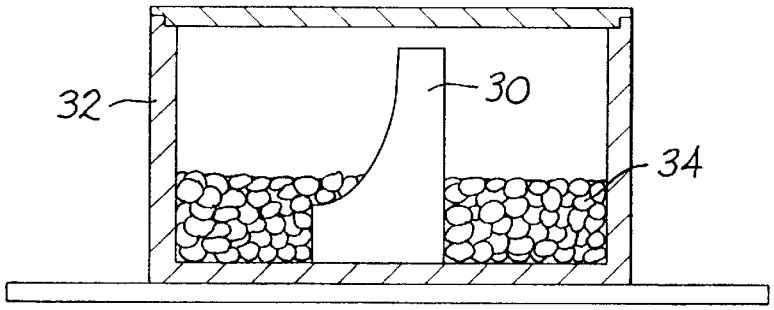
FIG. 2 is a side view of the arrangement in the furnace wherein a selected surface area of a second sintered body, which is a part of a die component, is surrounded by granules of sacrificial sintered material.
Figure 3:
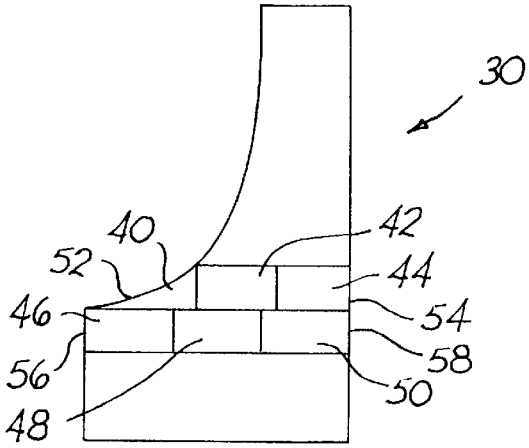
FIG. 3 is a schematic side view showing the six regions from the second sintered body which were analyzed for cobalt content.

Referring to FIGS. 2 and 3, there is depicted the specific embodiment which is a second example of the invention. In FIGS. 2 and 3, there is a section of a die component 30. The die component has a composition and properties of about 6 weight percent cobalt, about 0.2 weight percent vanadium, and the balance tungsten carbide. The die component had a coercive force of $H_c$ of about 350 Oe, a magnetic saturation of about 85 percent, and a tungsten carbide grain size of 1 micrometer.

Figure 6:
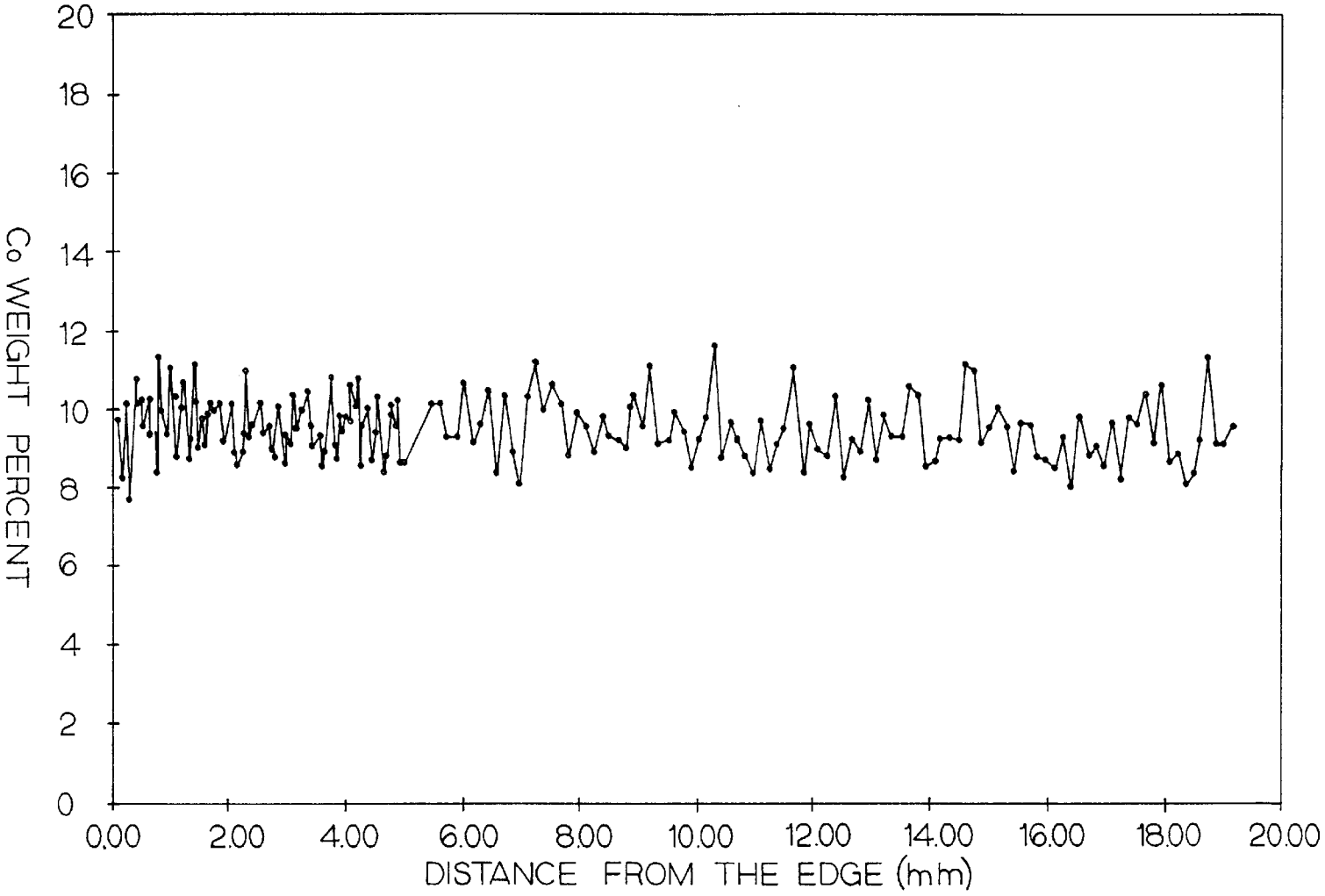
FIG. 6 is a cobalt profile (weight percent cobalt vs. distance from the surface in mm) for the sacrificial sintered material (prior to the heat treatment) used in the second example.

This die component 30 was placed in a furnace 32 and surrounded with coarse granules of a sacrificial sintered material 34 up to a certain height as depicted in FIG. 2. The sacrificial sintered material had a composition and properties comprising about 9.5 weight percent cobalt and the balance tungsten carbide. The coercive force $H_c$ was about 55 Oe, the magnetic saturation was about 96 percent, and the grain size of the tungsten carbide was between 1 and 25 micrometers. An EDS analysis showed that the cobalt profile (FIG. 6) for the sacrificial sintered material before heat treatment was relatively uniform.

Figure 7:
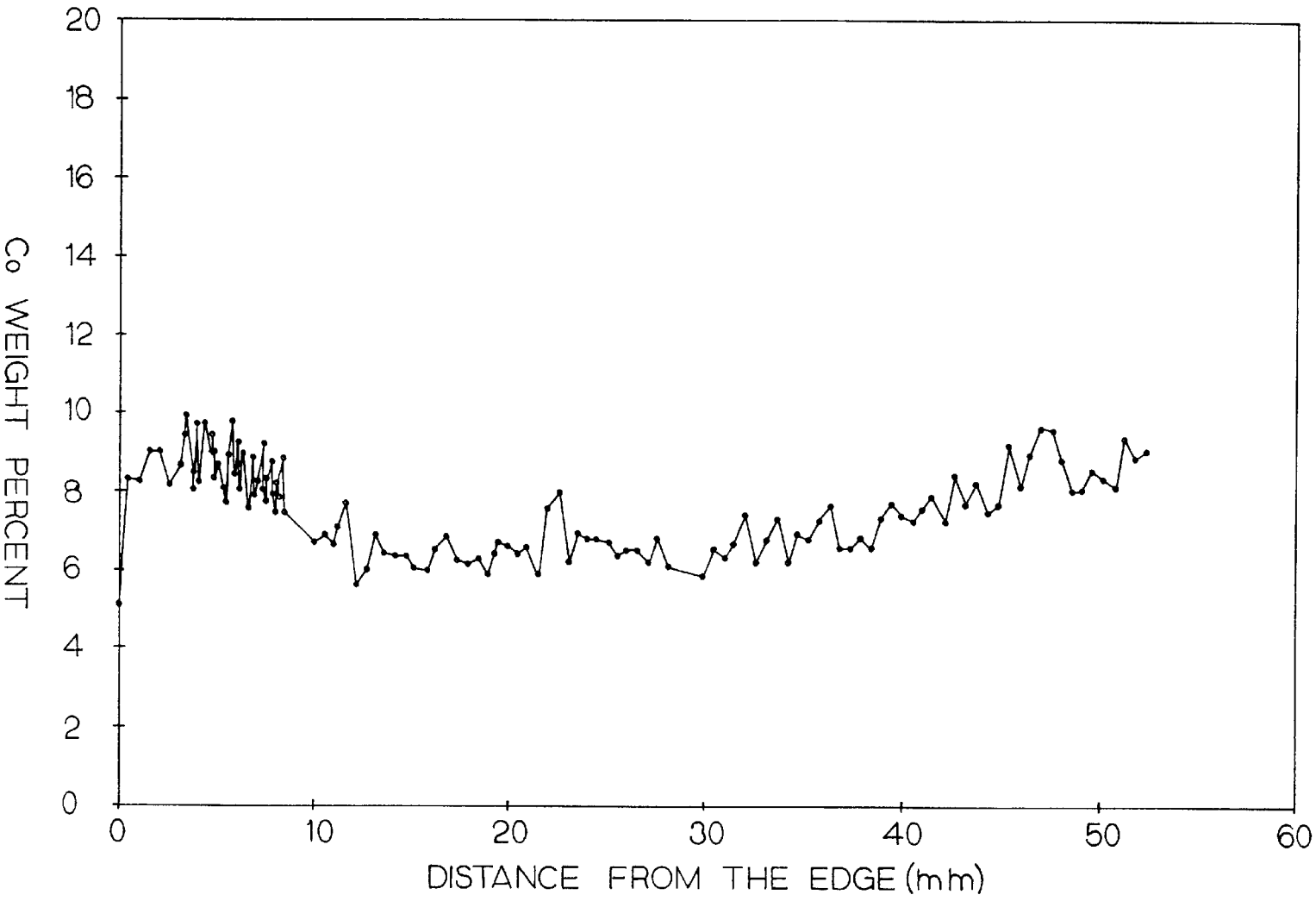
FIG. 7 is a cobalt profile (weight percent cobalt vs. distance from the surface in mm) for sections 40, 42 and 44 of the die component after the heat treatment.
Figure 8:
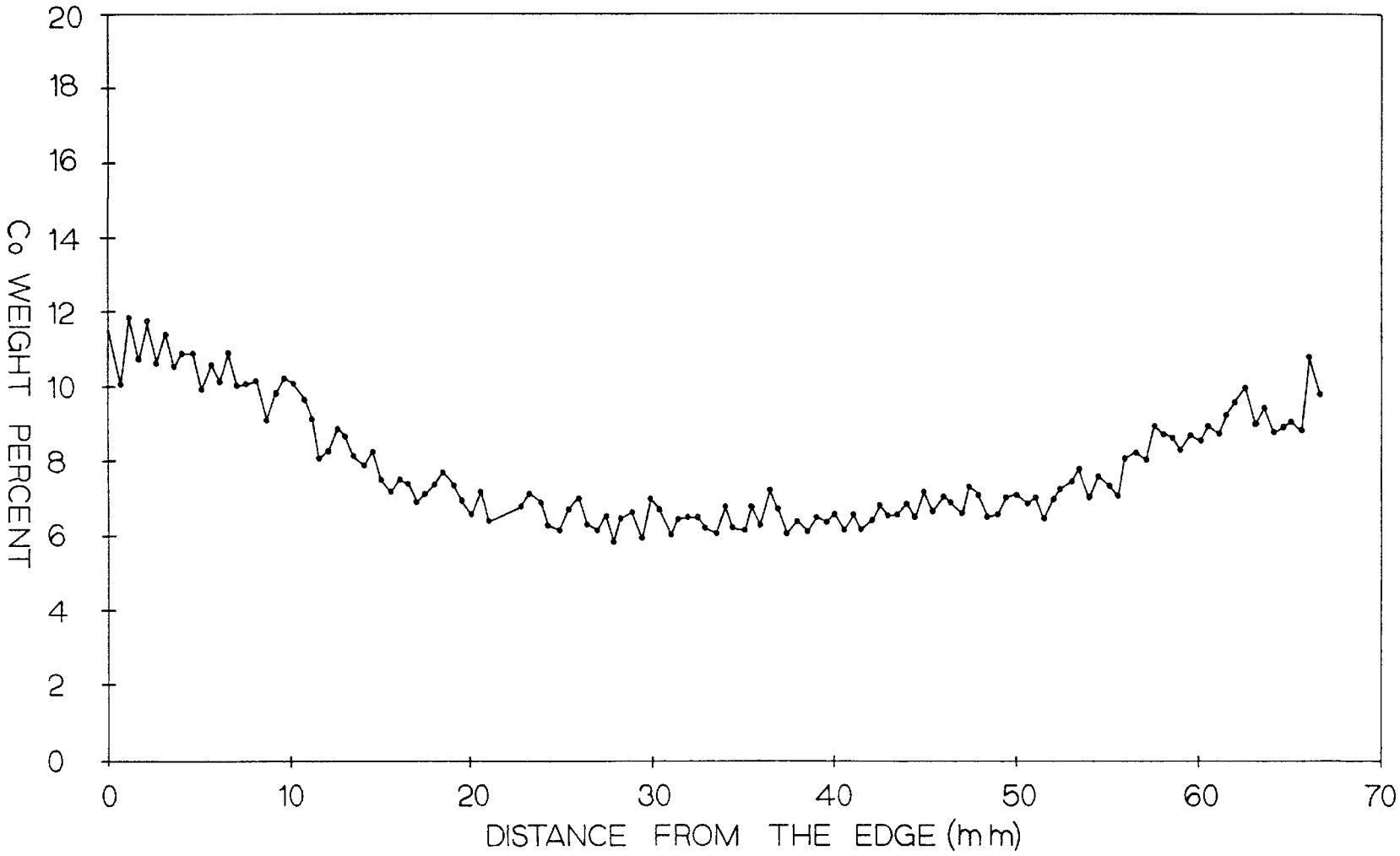
FIG. 8 is a cobalt profile (weight percent cobalt vs. distance from the surface in mm) for sections 46, 48 and 50 of the die component after the heat treatment.

This arrangement was sintered at 2550° F. (1399° C.) for 45 minutes at temperature under a 15 torr argon atmosphere. The die component sectioned according to the sections (40, 42, 44, 46, 48 and 50) called out in FIG. 3, and an EDS analysis was performed on each section. FIG. 7 is a cobalt profile for sections 40, 42, and 44 as shown in FIG. 3. FIG. 8 is a cobalt profile for sections 46, 48 and 50 as shown in FIG. 3.

Referring to FIG. 7, the cobalt has migrated into the die component 30 at both the arcuate surface 52 thereof and the flat surface 54 thereof. This is shown by the increased cobalt content at each end of the cobalt profile. One sees that the cobalt enrichment rises to a maximum of about 10 weight percent in the region of each exposed surface. In terms of an absolute weight percent cobalt, this is an increase of up to 4 weight percent. In terms of a percentage, this is an increase in the range of about 150 percent over the bulk cobalt content.

Referring to FIG. 8, like for the cobalt profile of FIG. 7, this profile shows that the cobalt migrated into the die component so as to form a cobalt enriched surface region at the opposite surfaces 56 and 58 of the die component 30. This is shown by the increased cobalt content at each end of the cobalt profile. One sees that the cobalt enrichment rises to a maximum of about 11 to 12 weight percent in the region of each exposed surface. This is an increase in the range of about 180 to 200 percent over the bulk cobalt content.

Figure 4:
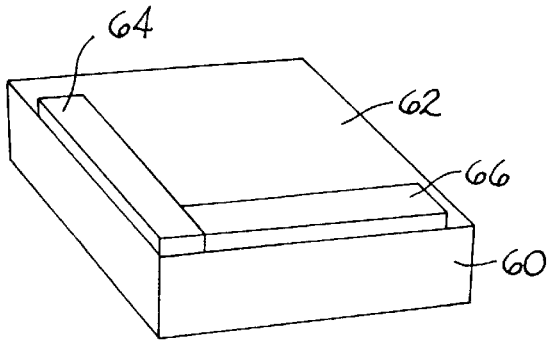
FIG. 4 is a perspective view of an arrangement wherein volumes of granules of a sacrificial sintered material are positioned at selected locations on the surface of a sintered body.

FIG. 4 depicts an arrangement wherein the sintered body 60 has a top surface thereof 62. A pair of separate and distinct volumes of granules (64, 66) are positioned at selected locations on the top surface 62. As can be appreciated, upon sintering of this arrangement, the cobalt content in the areas proximate to the volumes of granules will become enriched or depleted depending upon the specific application.

It is thus apparent that applicant has provided an improved method, and product produced by a method, wherein the binder content of the surface region of a sintered hard composite can be changed to either enrich the binder content or deplete the binder content. The specific application will dictate whether enrichment or depletion is the desired result. The depth and extent of change, i.e., depletion or enrichment, is influenced by the differential in binder content and grain size of the hard carbide between the sintered body and the sacrificial sintered material, as well as the time and temperature of sintering. A greater differential will result in a greater change. A longer time and a higher temperature will result in a greater migration of binder to either enrich or deplete the surface region of the sintered body.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A method of heat treating a sintered body having an exposed surface, the method comprising the steps of:

providing a sintered body comprised of a hard carbide and a binder, the binder being present in the sintered body at a first binder level and the hard carbide in the sintered body being of a first grain size;

placing granules of a sacrificial sintered material in contact with at least one portion of the exposed surface of the sintered body, the sacrificial sintered material comprised of the hard carbide and the binder, the binder being present in the sacrificial sintered material at a second binder level and the hard carbide in the sacrificial sintered material being of a second grain size; and heat treating the sintered body and sacrificial sintered material so as to change the binder content in a surface region of the sintered body.

2. The method of claim 1 wherein during the heat treating step some of the binder in the sacrificial sintered material migrates to the sintered body so that the binder content in the surface region of the sintered body increases.

3. The method of claim 2 wherein the binder content in the surface region of the sintered body is between about 125 percent and 200 percent of the binder content in the bulk of the sintered body.

4. The method of claim 1 wherein the first binder content is less than the second binder content.

5. The method of claim 4 wherein during the heat treating step some of the binder in the sacrificial sintered material migrates to the sintered body so that the binder content in the surface region of the sintered body increases.

6. The method of claim 1 wherein during the heat treating step some of the binder in the sintered body migrates to the sacrificial sintered material so that the binder content in the surface region of the sintered body decreases.

7. The method of claim 6 wherein the binder content in the surface region of the sintered body is between about 50 percent and about 85 percent of the binder content in the bulk of the sintered body.

8. The method of claim 1 wherein the first binder content is greater than the second binder content.

9. The method of claim 8 wherein during the heat treating step some of the binder in the sintered body migrates to the sacrificial sintered material so that the binder content in the surface region of the sintered body decreases.

10. The method of claim 1 wherein the first grain size is finer than the second grain size.

11. The method of claim 10 wherein during the heat treating step some of the binder in the sacrificial sintered material migrates to the sintered body so that the binder content in the surface region of the sintered body increases.

12. The method of claim 1 wherein the first grain size is coarser than the second grain size.

13. The method of claim 12 wherein during the heat treating step some of the binder in the sintered body migrates to the sacrificial sintered material so that the binder content in the surface region of the sintered body decreases.

14. The method of claim 1 wherein the hard carbide is tungsten carbide, and the binder is cobalt.

15. The method of claim 14 wherein the first binder content is about 6 weight percent cobalt, and the first grain size is about one micrometer.

16. The method of claim 15 wherein the second binder content is about 9.5 weight percent cobalt, and the second grain size is between 1 and 25 micrometers.

* * * * *